US007712603B2

(12) United States Patent
Mäder

(10) Patent No.: US 7,712,603 B2
(45) Date of Patent: May 11, 2010

(54) DEVICE FOR MONITORING SHEET PRODUCTS HELD TOGETHER IN A CLAMP

(75) Inventor: Carl Conrad Mäder, Hittnau (CH)

(73) Assignee: Ferag AG, Hinwil (CH)

( * ) Notice: Subject to any disclaimer, the term of this patent is extended or adjusted under 35 U.S.C. 154(b) by 425 days.

(21) Appl. No.: 11/745,174

(22) Filed: May 7, 2007

(65) Prior Publication Data

US 2007/0262516 A1 Nov. 15, 2007

(30) Foreign Application Priority Data

May 10, 2006 (CH) ..... 00756/06

(51) Int. Cl.
*B65H 7/02* (2006.01)

(52) U.S. Cl. ..... 198/644; 198/470.1; 198/803.3; 198/502.2; 271/262

(58) Field of Classification Search ..... 198/644, 198/470.1, 803.3, 803.7, 803.8, 803.9, 502.2; 271/3.13, 259, 262, 263
See application file for complete search history.

(56) References Cited

U.S. PATENT DOCUMENTS 4,217,491 A * 8/1980 Dufford et al. ..... 250/223 R
4,953,847 A * 9/1990 Honegger ..... 271/277
5,614,710 A * 3/1997 Mondie et al. ..... 250/223 R
6,876,716 B2 * 4/2005 Sjogren et al. ..... 377/8
6,976,674 B2 * 12/2005 Honegger ..... 271/204
7,455,171 B2 * 11/2008 Buechel ..... 198/502.2
2002/0113977 A1 8/2002 Silvestre

FOREIGN PATENT DOCUMENTS

WO WO 2007/012206 A1 2/2007

* cited by examiner

*Primary Examiner*—Mark A Deuble
(74) *Attorney, Agent, or Firm*—Alston & Bird LLP

(57) ABSTRACT

A device according to the invention for monitoring two sheet products transported by means of a clamp of a transport device. The device has at least two sensors that are intended to generate signals on the basis of which the number of products held in the clamp can be determined. A first sensor hereby generates a first detection signal referred to as reference signal when a clamp passes a reference area assigned to this first sensor. The second sensor is arranged in such a way that it generates a second detection signal when at least one section of one of the products in a second side edge area free from the clamp passes through its assigned detection area.

13 Claims, 1 Drawing Sheet

DEVICE FOR MONITORING SHEET PRODUCTS HELD TOGETHER IN A CLAMP

BACKGROUND OF THE INVENTION

The present invention relates to a device for monitoring sheet products, in particular printed products, transported in a transport device by means of clamps.

A method and a device for monitoring pairs of sheet products bearing identification information, each transported in a clamp of a transport device, are known from the Swiss patent application with the application number 01276/05. As they pass a monitoring point, the products are subjected to an opto-electronic check with an image recording device. The images of the identification information recorded in this way are compared with given calibration images in an electronic further processing device. As a result of this comparison it is possible to determine whether the clamp was carrying the predetermined products. In the event of an error, control signals can be transmitted to downline processing devices so that a separate treatment of clamps holding the wrong products can be initiated.

In order to ensure high reliability in the recording of the identification information, it is necessary that this information always passes in roughly the same positions during the recording. In the above-mentioned patent application, this is ensured in that the identification information is contained on edge sections of each product in a side edge area of the products that is firmly gripped by the clamp jaws of the clamp. As the image recording device has to be located relatively close to the passing clamps during the recording of the identification information, positioning and installation problems can occur with some clamp transport devices due to the limited space available. An object is therefore to provide an improved monitoring device that allows the number of sheet products transported in a clamp to be monitored in the simplest and most reliable manner possible.

SUMMARY OF THE INVENTION

This object and others are achieved by providing a device for monitoring sheet products, in particular printed products, transported in a transport device by means of clamps in one transport direction, wherein the clamps are each intended to hold a first product and a second product simultaneously in a first side edge area in such a way that the products partially overlap one another and thereby form overlap-free edge sections, the device comprising at least two sensors, namely a first sensor and a second sensor, that are intended to generate signals on the basis of which the number of products held in the clamp can be determined, and wherein the first sensor is intended to generate a first detection signal referred to as reference signal when a clamp passes a reference area assigned to the first sensor, and the second sensor is arranged in such a way that it generates a second detection signal when at least one section of one of the products in a second side edge area free from the clamp passes through a detection area assigned to the second sensor.

The device according to the invention serves to monitor sheet products transported by means of clamps of a transport device in one transport direction. Pairs of at least partially overlapping products are gripped by a clamp in a first side edge area. The device is equipped with two sensors, whereby a first sensor is intended to generate a first detection signal referred to as reference signal when a clamp passes a reference area assigned to the first sensor. A second sensor is arranged in such a way that a so-called second detection signal is generated when at least one section of one of the products from a second side edge area free from the clamps passes through a detection area assigned to the second sensor.

The arrangement in which the second sensor is oriented to the free second side edge area avoids a possible spatial obstruction of the transport device moving the clamps. In addition the installation, maintenance and adjustment work for the second sensor can be reduced with this arrangement.

Compared with the prior art it is furthermore possible to waive identification information on the products and to use particularly inexpensive sensors, for example single-cell photodetectors instead of image recording devices.

BRIEF DESCRIPTION OF THE DRAWINGS

Figure 1:
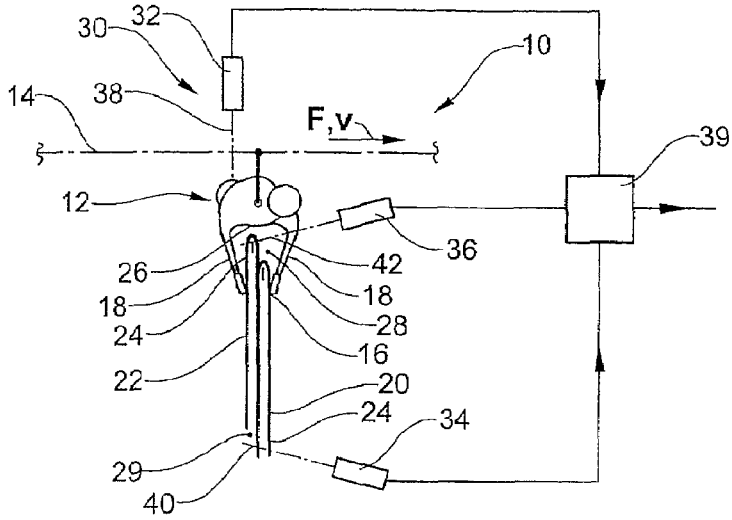
Figure 2:
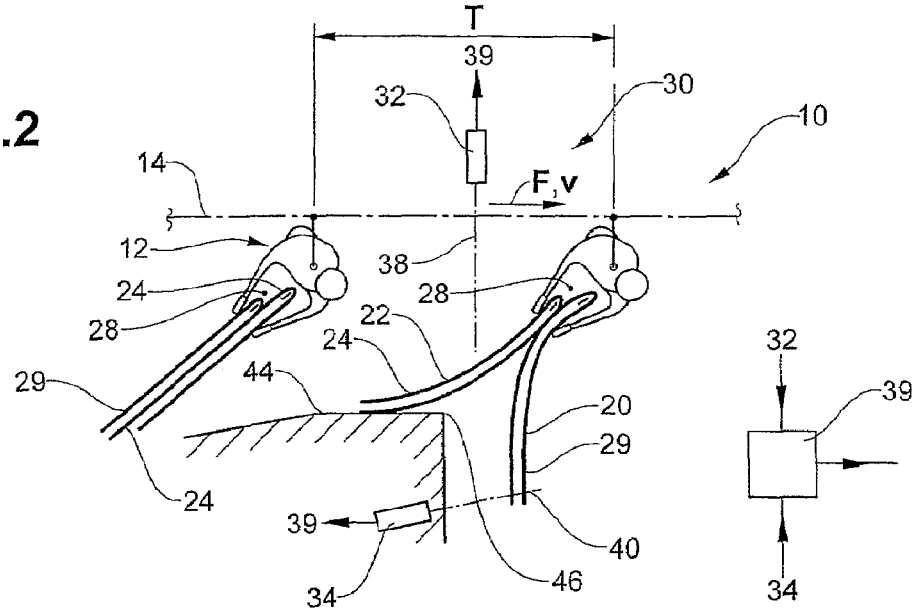
Figure 3:
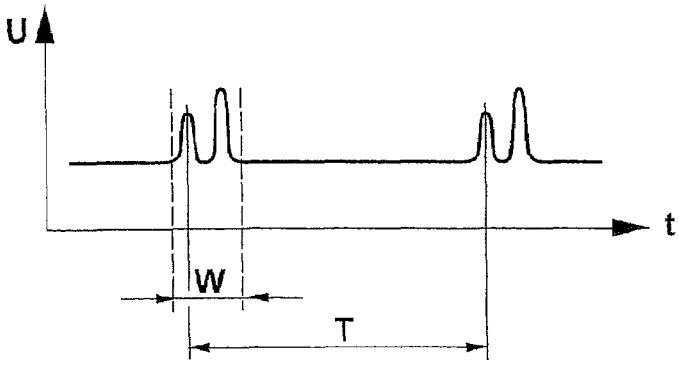

Having thus described the invention in general terms, reference will now be made to the accompanying drawings, which are not necessarily drawn to scale, and wherein:

FIG. 1 is a side view of a first embodiment of a monitoring device according to the invention equipped with three sensors;

FIG. 2 is a side view of a further embodiment of the monitoring device according to the invention with two sensors, whereby the second sensor in the transport direction is arranged downline of a deflection element; and FIG. 3 is a diagram of a detection signal of the second sensor shown as a function of the signal size U and the time t for the embodiment shown in FIG. 2 when two completely filled clamps each with two sheet products pass the detection area assigned to the second sensor.

DETAILED DESCRIPTION OF THE INVENTION

The present invention now will be described more fully hereinafter with reference to the accompanying drawings, in which some, but not all embodiments of the invention are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

FIG. 1 shows in a side view diagrammatically a section of a transport device 10 in which clamps 12 (of which only one is shown) are arranged spaced behind one another on a transport organ 14. The transport organ 14 can, for example, be designed as a conveyor chain or as a conveyor belt. It is driven in a transport direction F at a transport speed v. Alternatively it is naturally also possible that the clamps 12 are arranged, for example, on rail-guided carriages whose movement is supported in particular also sectionally by the force of gravity.

The clamps 12 have a clamp mouth 16 that can be opened and closed by mechanical actuation. A leading first printed product 20 and a following second printed product 22 traveling in transport direction F are held together in the clamp mouth 16 between two clamp jaws 18. The printed products 20, 22 can be, for example, folded printed products such as newspapers and magazines, but also other single or multilayer sheet products.

The printed products 20, 22 lie partially overlapped while forming overlap-free edge sections 24. In the embodiment shown in FIG. 1, the following second printed product 22 in transport direction F is closer to the root 26 of the clamp mouth 16 than the leading first printed product 20 in transport direction F. Alternatively it is also possible that the leading first printed product 20 in transport direction F is closer to the root 26 of the clamp mouth 16 than the following second printed product 22 in transport direction F. As a result of the clamping of the two printed products 20, 22 in the clamp mouth 16, a first side edge area 28 extending from the free ends of the clamp jaws 18 in the direction of the root 26 of the clamp mouth 16 on the two printed products 20, 22 is gripped firmly. In the embodiment illustrated, the first side edge area 28 is essentially formed by fold-side sections of the printed products 20, 22.

A second side edge area 29 lying opposite the first side edge area 28 encompasses the free, to a certain extent also freely moving, end sections of the printed products 20, 22 including an overlap-free edge section 24 of the first printed product 20.

Three stationary sensors, namely a first sensor 32, a second sensor 34 and a third sensor 36 are arranged at a monitoring point 30. The first sensor 32 is a so-called "clamp sensor" and monitors an assigned reference area 38 represented by the dot-dashed line extended from it. As soon as a clamp 12 passes this reference area 38, the sensor triggers a first detection signal referred to as reference signal. This reference signal is transmitted further to an evaluation circuit 39 and serves to trigger a predetermined time interval during which a so-called second detection signal of the second sensor 34 and a so-called third detection signal of the third sensor 36 are detected.

The first sensor 32 can naturally thereby also be located at a greater distance upstream (relative to the transport direction F) of the second sensor 34 and the third sensor 36 than that shown in FIG. 1. In this case the predetermined time interval preferably starts at a later point in time after the passage of the clamp 12 that has been determined in relation to the distance of the first sensor 32 from the second and third sensor 34, 36 and to the transport speed v.

The second sensor 34 is arranged such that its assigned detection area 40 is oriented to the second side edge area 29 that lies opposite the clamp 12, in particular to the lower overlap-free edge section 24 of the first printed product 20. With such an arrangement of the second sensor 34 below and distant from the transport organ 14, its installation and adjustment are very simple and possible with good accessibility.

If the overlap-free edge section 24 of the first printed product passes through the detection area 40 of the second sensor 34 within a time interval triggered by the reference signal of the first sensor 32, the second detection signal of this sensor 34 will be transmitted to the evaluation circuit 39 and the presence of the first printed product 20 registered. Should the overlap-free edge section 24 not pass the detection area 40 within the triggered time interval, no second detection signal will be transmitted to the evaluation circuit 39, and on expiry of the time interval the evaluation circuit 39 registers that the first printed product 20 was not present. The evaluation circuit 39 can then transmit control signals to downline processing devices so that special treatment of the clamp 12 not holding the first printed product 20 can be initiated.

In order to detect the presence of the second following printed product 22 in transport direction F, the third sensor 36 is oriented in such a way that its detection area 42 monitors the overlap-free edge section 24 of the second printed product 22 in the first side edge area 28. By analogy with the function of the second sensor 34, the third sensor 36 also transmits the third detection signal to the evaluation circuit 39 as soon as the second printed product 22 passes the detection area 42 within the triggered time interval. If the second printed product 22 is not detected because, for example, the second printed product 22 has not passed through the detection area 42 or the printed products 20, 22 are lying completely on top of one another at the position of the first printed product 20, an error will again be registered by the evaluation circuit 39 in this case and corresponding error handling procedures initiated.

FIG. 2 shows a further embodiment of the monitoring device according to the invention. In the section of the transport device 10 around the monitoring point 30 shown, two clamps 12 with a first printed product 20 and a second printed product 22 respectively lying on top of one another and at least partially overlapped to form overlap-free edge sections 24 are illustrated. By contrast with the embodiment shown in FIG. 1 in which either the following printed product 22 or the leading printed product 20 can be arranged closer to the root 26 of the clamp mouth 16 without the function of the monitoring device being impaired, it is essential with the embodiment shown in FIG. 2 that the leading first printed product 20 in transport direction F extends further into the clamp mouth 16 than the trailing second printed product 22.

With this embodiment, too, the first sensor 32 detects the passage of a clamp 12 through its reference area 38 and transmits its reference signal to the evaluation circuit 39, thereby triggering a time window in which second detection signals generated by the second sensor 34 can be registered. In this embodiment, a ramp-like deflection element 44, for example in the form of a supporting plate, is assigned to the second sensor 34.

The detection area 40 of the second sensor 34 extends as seen in transport direction F in the shadow of the deflection element 44. As the clamps 12 with the printed products 20, 22 approach, the second side edge area 29 of the printed products 20, 22 slides onto the deflection element 44. On passing a rear (as seen in transport direction F) deflection element edge 46 of the deflection element 44, the section of the first printed product 20 assigned to the second side edge area 29 swings through the detection area 40 of the second sensor 34. If the first printed product 20 is present and held in the correct position in the clamp 12, this is detected by the second sensor 34 which transmits a corresponding second detection signal to the evaluation circuit 39.

The second printed product 22 initially still sliding along the elevated deflection element 44 during the passage of the first printed product 20 through the detection area 40 of the second sensor 34 also swings through the detection area 40 of the second sensor 34 after passing over the deflection edge 46, thereby triggering a second detection signal for transmission to the evaluation circuit 39. If the evaluation circuit 39 does not register the two corresponding, temporally offset second detection signals of the second sensor 34 within the triggered time interval, for example because only one printed product 20, 22 was present in the clamp 12 or the printed products 20, 22 were lying completely on top of one another, an error state will again be detected and corresponding error handling procedures initiated.

With both embodiments of the monitoring device according to the invention described, it is possible to determine whether neither of the printed products, or just one or both of the printed products 20, 22 were present in a clamp 12 transported past the monitoring point 30. If only one printed product 20, 22 was present, then it is also possible to determine which printed product 20, 22 was missing and which was present, in the embodiment shown in FIG. 1 on the basis of the assignment of the detection signals to one of the sensors 34, 36 and in the embodiment shown in FIG. 2 on the basis of the time of the detection.

The diagram in FIG. 3 shows for the second detection signals of the second sensor 34 the signal size U as a function of the time t for the passage of two clamps 12 with a first printed product 20 and a second printed product 22 respectively past the monitoring point 30 for the embodiment of the monitoring device according to the invention shown in FIG. 2. The signal curve shows two double peaks offset from one another by a time difference T, whereby the earlier smaller signal peak in each case is to be assigned to the passage of the first printed product 20 through the detection area 40 of the second sensor 34 and the later larger signal peak in each case to the passage of the second printed product 22 through the detection area 40 of the second sensor 34.

The time difference T between the respective earlier and later signal peaks corresponds at least roughly to the quotient of the distance between the clamps 12 and their transport speed v, insofar as the two parameters remain constant between the passage through the detection area 40. The time interval W also plotted in the diagram indicates a time window triggered by the reference signal during which the second detection signals of the second sensor 34 are expected with complete filling of the clamps with printed products 20, 22 and during which they are acquired or taken into consideration by the evaluation circuit 39.

The signal sizes of the signal peaks assigned in each case to the first printed product 20 and the second printed product 22 respectively differ, as due to the mutually offset position of the printed products 20, 22 sections of the detection area 40 of the second sensor 34 of different size are covered by the printed products 20, 22. Conversely, the signal size allows the holding of the printed products 20, 22 in the correct position in the clamps 12 to be assessed.

The sensors 32, 34, 36 are preferably designed as very inexpensive, contact-free, optical sensors, for example optical proximity sensors, light barriers, etc., or as mechanical sensors. However, the use of image recording devices such as digital cameras with recording being triggered after the clamp passage or continuously during a triggered time interval as sensors 32, 34, 36 is also possible. In particular the first sensor 32 for detection of the clamps 12 can, however, also be designed as a mechanical, capacitive or inductive proximity switch.

In practice, both the reference area 38 and the detection areas 40 and 42 frequently do not have a linear form and may have a spatial range, depending on the sensor type used. The fact that the reference area 38 or the detection areas 40, 42 also detect overlapping sections of the printed products 20, 22 during the detection of the passage of overlap-free edge sections 24 of the printed products 20, 22 has no major significance for the monitoring device according to the invention, but can—as already mentioned above—also be used to determine whether the printed products are held in the correct position in the clamps.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A device for monitoring sheet products, in particular printed products, transported in a transport device by means of clamps in one transport direction, wherein the clamps each hold a first product and a second product simultaneously in a first side edge area in such a way that the products partially overlap one another and thereby form overlap-free edge sections, the device comprising at least two sensors, namely a first sensor and a second sensor, that generate signals on the basis of which the number of products held in the clamp can be determined, and wherein the first sensor generates a first detection signal referred to as reference signal when a clamp passes a reference area assigned to the first sensor, and the second sensor is arranged in such a way that it generates a second detection signal when at least one section of one of the products in a second side edge area free from the clamp passes through a detection area assigned to the second sensor.

2. A device for monitoring sheet products, in particular printed products, transported in a transport device by means of clamps in one transport direction, wherein the clamps each hold a first product and a second product simultaneously in a first side edge area in such a way that the products partially overlap one another and thereby form overlap-free edge sections, the device comprising at least two sensors, namely a first sensor and a second sensor, that generate signals on the basis of which the number of products held in the clamp can be determined, and wherein the first sensor generates a first detection signal referred to as reference signal when a clamp passes a reference area assigned to the first sensor, and the second sensor is arranged in such a way that it generates a second detection signal when at least one section of one of the products in a second side edge area free from the clamp passes through a detection area assigned to the second sensor, wherein a deflection element is assigned to the second sensor by means of which the products are distanced from one another in the free second side edge area when sliding over the deflection element and pass individually in turn through the detection area of the second sensor, so that second detection signals are generated by the second sensor.

3. The device as claimed in claim 2, wherein the sensors are connected electrically to an evaluation circuit which on the basis of the temporal sequence or the size of the detection signals determines the number of products or monitors the complete filling of the clamps with products.

4. The device as claimed in claim 3, wherein the evaluation circuit registers the detection signals of the second sensor and possibly of further sensors only during a predetermined time interval that is triggered by the reference signal generated by the first sensor.

5. A device for monitoring sheet products, in particular printed products, transported in a transport device by means of clamps in one transport direction, wherein the clamps each hold a first product and a second product simultaneously in a first side edge area in such a way that the products partially overlap one another and thereby form overlap-free edge sections, the device comprising at least two sensors, namely a first sensor and a second sensor, that generate signals on the basis of which the number of products held in the clamp can be determined, and wherein the first sensor generates a first detection signal referred to as reference signal when a clamp passes a reference area assigned to the first sensor, and the second sensor is arranged in such a way that it generates a second detection signal when at least one section of one of the products in a second side edge area free from the clamp passes through a detection area assigned to the second sensor, wherein the second sensor and a third sensor are arranged in such a way that during the passage of the products, the detection area of the second sensor detects an overlap-free edge section of the first product and a detection area of the third sensor detects an overlap-free edge section of the second product, so that the second detection signal is generated by the second sensor, depending on the presence of the first product and a third detection signal is generated by the third sensor, depending on the presence of the second product.

6. The device as claimed in claim 5, wherein the detection areas of the second sensor and third sensor detect the overlap-free edge sections of the first product and the second product, respectively, at least almost exclusively.

7. The device as claimed in claim 5, wherein the sensors are connected electrically to an evaluation circuit which on the basis of the temporal sequence or the size of the detection signals determines the number of products or monitors the complete filling of the clamps with products.

8. The device as claimed in claim 7, wherein the evaluation circuit registers the detection signals of the second sensor and the third sensor only during a predetermined time interval that is triggered by the reference signal generated by the first sensor.

9. A device for monitoring sheet products, in particular printed Products, transported in a transport device by means of clamps in one transport direction, wherein the clamps each hold a first product and a second product simultaneously in a first side edge area in such a way that the products partially overlap one another and thereby form overlap-free edge sections, the device comprising at least two sensors, namely a first sensor and a second sensor, that generate signals on the basis of which the number of products held in the clamp can be determined, and wherein the first sensor generates a first detection signal referred to as reference signal when a clamp passes a reference area assigned to the first sensor, and the second sensor is arranged in such a way that it generates a second detection signal when at least one section of one of the products in a second side edge area free from the clamp passes through a detection area assigned to the second sensor, wherein the second sensor and a third sensor are arranged in such a way that during the passage of the products, the detection area of the second sensor detects an overlap-free edge section of the second product and a detection area of the third sensor detects an overlap-free edge section of the first product, so that the second detection signal is generated by the second sensor, depending on the presence of the second product and a third detection signal is generated by the third sensor, depending on the presence of the first product.

10. The device as claimed in claim 9, wherein the detection areas of the second sensor and third sensor detect the overlap-free edge sections of the second product and the first product, respectively, at least almost exclusively.

11. A device for monitoring sheet products, in particular printed products, transported in a transport device by means of clamps in one transport direction, wherein the clamps each hold a first product and a second product simultaneously in a first side edge area in such a way that the products partially overlap one another and thereby form overlap-free edge sections, the device comprising at least two sensors, namely a first sensor and a second sensor, that generate signals on the basis of which the number of products held in the clamp can be determined, and wherein the first sensor generates a first detection signal referred to as reference signal when a clamp passes a reference area assigned to the first sensor, and the second sensor is arranged in such a way that it generates a second detection signal when at least one section of one of the products in a second side edge area free from the clamp passes through a detection area assigned to the second sensor, the second side edge area being opposite the first side edge area.

12. The device as claimed in claim 11, wherein one of the sensors is designed as an optical sensor, in particular as an optical proximity sensor or as a light barrier or as an image recording device.

13. The device as claimed in claim 11, wherein one of the sensors is designed as a mechanical sensor, in particular as a mechanical proximity switch, or as a capacitive sensor or as an inductive sensor.

* * * * *